United States Patent [19]

Sher

[11] 4,054,268

[45] Oct. 18, 1977

[54] GLASS PANEL RAILING

[76] Inventor: Emil Z. Sher, 1735 SW. 90 Ave., Miami, Fla. 33165

[21] Appl. No.: 685,703

[22] Filed: May 12, 1976

[51] Int. Cl.[2] ..... E04H 17/14

[52] U.S. Cl. ..... 256/24; 256/67

[58] Field of Search ..... 256/24, 21, 22, 31, 256/65–70

[56] References Cited

U.S. PATENT DOCUMENTS

| | | | |
|---|---|---|---|
| 3,156,450 | 11/1964 | Thom | 256/65 X |
| 3,321,059 | 5/1967 | Kroepel | 256/24 X |
| 3,358,969 | 12/1967 | Blum et al. | 256/24 |
| 3,468,516 | 9/1969 | Jounot | 256/24 |
| 3,630,490 | 12/1971 | Horgan, Jr. | 256/24 |
| Re. 28,643 | 12/1975 | Blum | 256/24 |

*Primary Examiner*—Andrew V. Kundrat

[57] ABSTRACT

A glass panel railing for mounting alongside a stairway and other building surfaces such as a walkway, etc., wherein a plurality of glass panels, carrying a continuous handrail along their upper edges, are adjustably, vertically mounted relative to the building structure.

14 Claims, 7 Drawing Figures

GLASS PANEL RAILING

FIELD OF THE INVENTION

The present invention pertains to a continuous glass panel railing which is both ornamental and utilitarian in nature.

STATE OF THE PRIOR ART

U.S. Pat. No. Re. 28,643 to Harry P. Blum discloses a variety of mounting means for an ornamental glass panel railing. The first four forms of this Patent illustrate relatively small bracket assemblies in a spaced relation along the length of the glass panel railing, two assemblies to each glass panel, the glass panels of three of these forms being rigidly attached to the respective bracket assemblies by bolts extending through holes in the glass. In all four forms the bracket assemblies are comprised of a plurality of elements, generally four or five. All of these elements, the glass panels and the attachments to the building structure are completely rigid.

The final two forms of the aforementioned Patent utilize a structural receiving member which, in one form, is bolted to the outer surface of the building structure and in a slot in the building structure in a second form. In both forms, however, all of the elements, including the glass panels, are rigidly interconnected as well as being rigidly fixed to the building structure.

Therefore, in all six forms disclosed in this Patent, all assembly and mounting connections are rigid and provide no adjustment means to accurately orient a row of glass panels in a perfectly, vertically aligned disposition.

BACKGROUND OF THE PRESENT INVENTION

The glass panel mounting structure of the present invention provides a continuous support means for a plurality of glass panels, as employed in a glass panel railing, a continuous adjustment means along the support means, and a continuous clamp means to clamp and maintain the glass panels in a perfectly aligned, vertical attitude relative to each other.

It is a well known fact that building structures generally are formed to a sufficiently accurate degree to be pleasing to the eye, yet, when a straight edge or level, for example, is applied to the surfaces of the structure, varying degrees of inaccuracies are generally disclosed. Without a means to compensate for these inaccuracies, a glass panel railing, following the natural contours, will generally display and often amplify the inaccuracies. Even when the support structures are embedded in slots, grooves or the like as are some forms of the aforementioned Patent, the inaccuracies are apparent because such slots, grooves, etc., are generally formed by cutting tools which follow the surface contours. When a plurality of spaced apart anchors, as in the first form of the Patent, are to be embedded in the original structure, it is also extremely difficult to maintain a consistantly perfect degree of accuracy.

It is therefore, a principal object of the present invention to provide a glass panel railing, formed of a plurality of aligned glass panels, which includes mounting means and adjustment means along the length of the run of panels to accurately orient the panels in a perfectly aligned, vertical disposition.

A further object of this invention is to provide a clamp means to permanently maintain the panels in the desired, aligned attitude.

Another object of the invention is to provide mounting means for fixed attachment to a vertically disposed surface.

A still further object of the instant invention is to provide an alternative mounting means for fixed attachment to a transversely horizontal surface in both inclined and longitudinally horizontal attitudes.

Another object of the invention is to provide pad engagement means between the glass panels and all metal elements of the support, adjustment and clamp means.

DETAILED DESCRIPTION OF THE DRAWINGS

Figure 1:
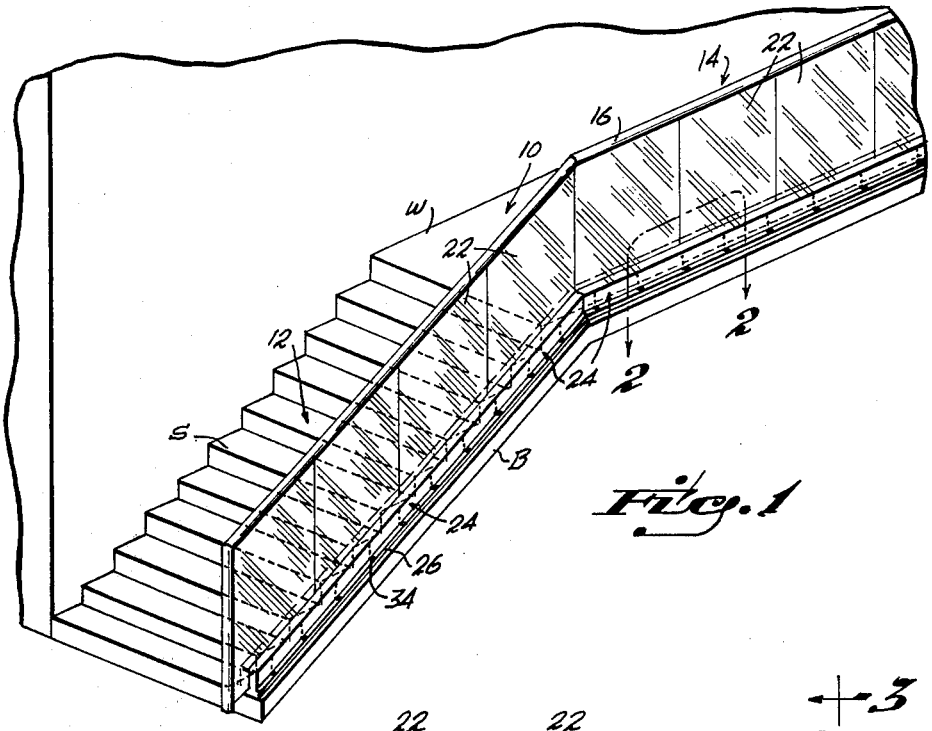
FIG. 1 is a perspective view of a stairway, and walkway thereabove, with the glass panel railing of the present invention installed relative to the outer edges thereof.

With reference to the drawings in which like reference characters designate like or corresponding parts throughout the various views and with particular reference to FIG. 1, the glass panel railing of the present invention is indicated generally at 10. A first portion of railing 10, indicated generally at 12, is illustrated in a fixed relation to the outer edge of a stairway S and a second portion 14 thereof is illustrated in a fixed relation to the outer edge of a walkway W leading away from the top of stairway S.

Figure 5:
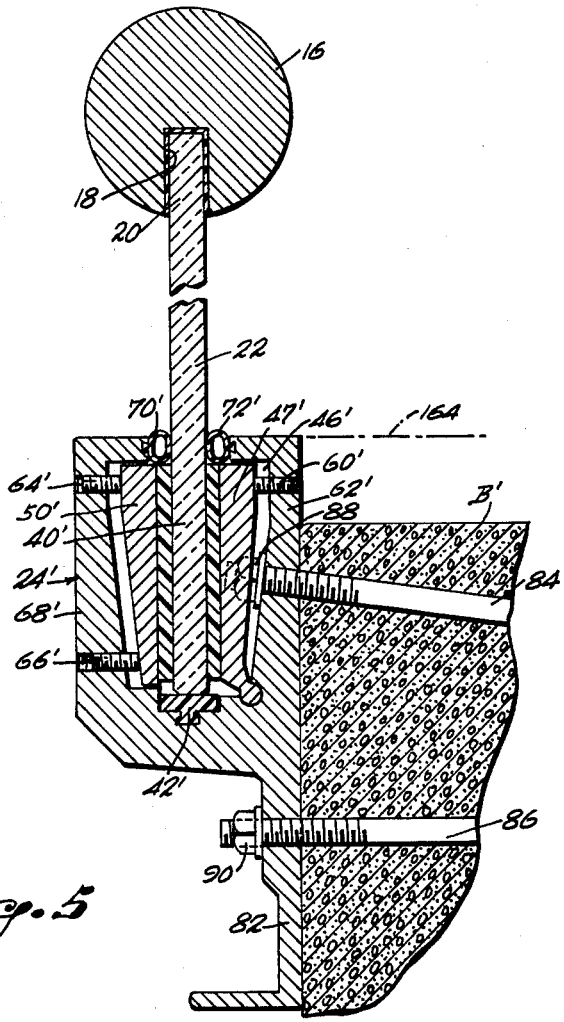
FIG. 5 is an enlarged cross sectional view taken along line 5—5 of FIG. 4.
Figure 7:
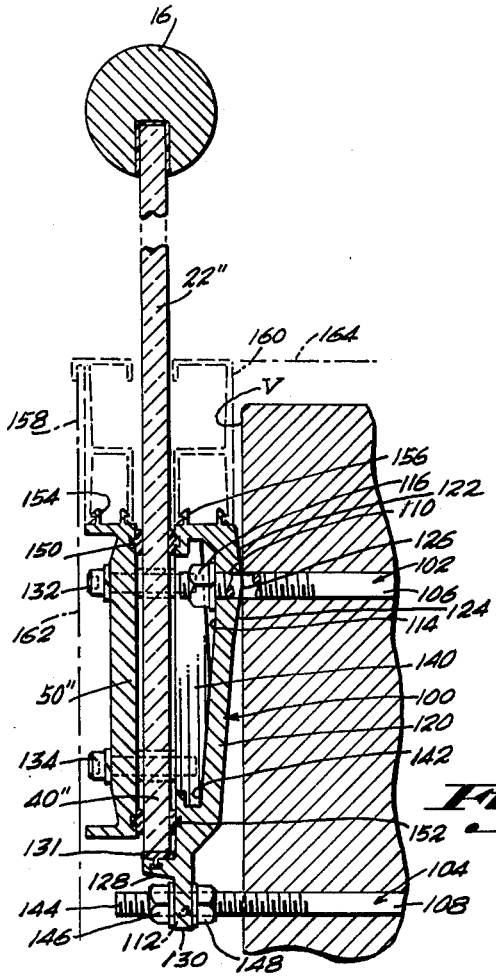
FIG. 7 is a cross sectional view taken along line 7—7 of FIG. 6.

The functions and structure of both portions 12 and 14 are identical and is detailed and described relative to the portion within the line 2—2 of FIG. 1. As illustrated in FIGS. 1, 5 and 7, a continuous handrail 16 is grooved at 18 to receive the top edges 20 of the plurality of glass panels 22. The handrail 16 is secured by any suitable adhesive to said top edges 20.

Figure 2:
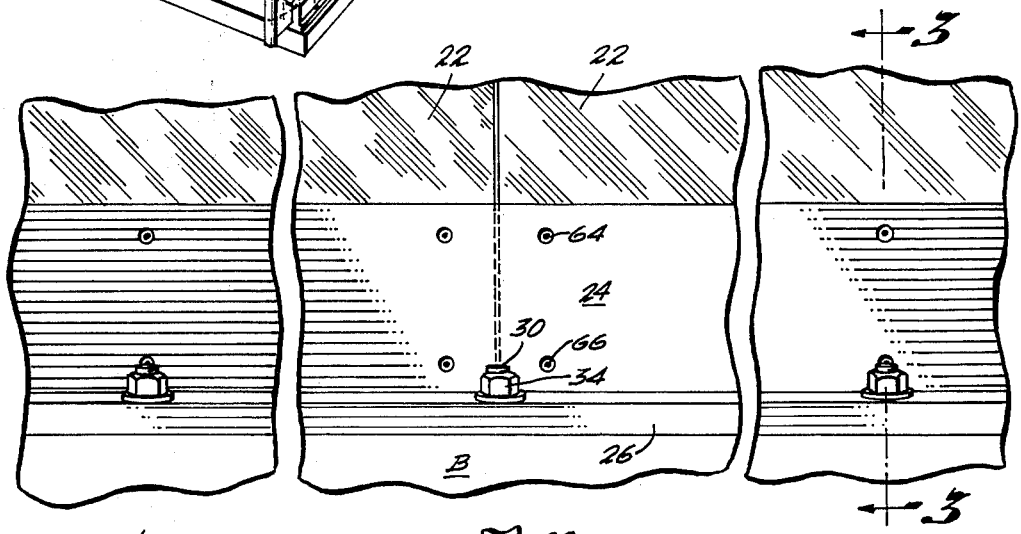
FIG. 2 is a fragmentary, enlarged elevational view of the portion of FIG. 1 within the line 2—2.
Figure 3:
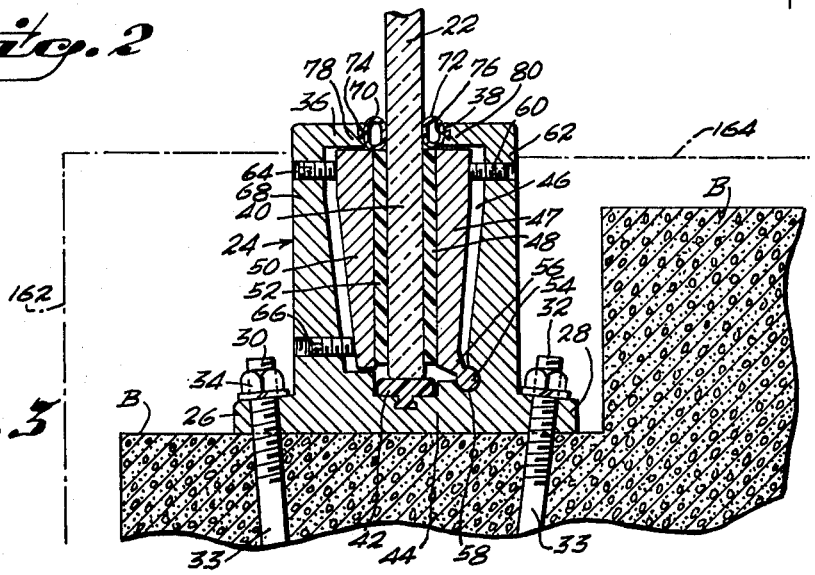
FIG. 3 is a further enlarged cross sectional view taken along line 3—3 of FIG. 2.

With particular reference to FIGS. 2 and 3, a glass panel support member 24, generally of a rectangular, tubular, cross sectional configuration, includes a pair of opposed, bottom, outwardly extending flanges 26 and 28 for reception therethrough of pluralities of spaced apart anchor bolts 30 and 32. Bolts 30 and 32 have elongated inner end portions 33 embedded in a transversely horizontal portion of the building structure B on both the inclined stairway and walkway portion 12 and 14. Washer and lock nuts 34 are engaged on the extended ends of said bolts 30 and 32 to hold the support member 24 in place.

The top wall 36 of tubular support member 24 is provided with a central, longitudinally extending slot 38 for the reception therethrough of the bottom end portions 40 of glass panels 22. The bottom edges of glass panels 22 are supported on pads 42 fixed in the bottom wall 44 of support member 24.

Within a chamber 46, defined in tubular member 24, is an elongated adjustment plate 47 and a related pad 48 engaged along a first side of the bottom end portions 40 of glass panels 22. A pressure plate and pad 50 and 52 is disposed in chamber 46 and engaged along a second side of bottom end portions 40 of glass panels 22. As seen in FIG. 3, a longitudinally extending bead 54 is integrally connected by a reduced width neck portion 56 to the inner bottom edge of adjustment plate 47 for pivotal engagement in a companionately shaped groove 58 in the inner bottom corner of chamber 46. A plurality of spaced apart set screws 60 are threaded through an inner wall 62 of tubular support member 24 into engagement with the upper end portion of adjustment plate 47. Therefore, it can be seen that proper adjustment of set screws 60 along the length of support member 24 will rock adjustment plate 47 about the axis of bead 54 to bring the plurality of glass panels 22, engaged by pad 48 of adjustment plate 47, into a proper vertical alignment.

Upper and lower pluralities of spaced apart set screws 64 and 66 are threaded through outer wall 68 of support member 24 into engagement with pressure plate 50. Proper adjustment of set screws 64 and 66 engage pad 52 of pressure plate 50 against the lower end portions 40 of glass panels 22 in an opposed relation to adjustment plate 47 to secure the glass panels 22 in the properly aligned relation.

As illustrated in FIG. 3, the slot 38 in the top wall 36 of support member 24 is widened considerably relative to the thickness of glass panels 22 to permit the aforementioned rocking adjustment thereof. A pair of resilient, O-formed seal members 70 and 72 are disposed in the slot 38 on opposed sides of the glass panels 22 and fixed at 74 and 76 in the respective edge portions 78 and 80 of support member 24.

Figure 4:
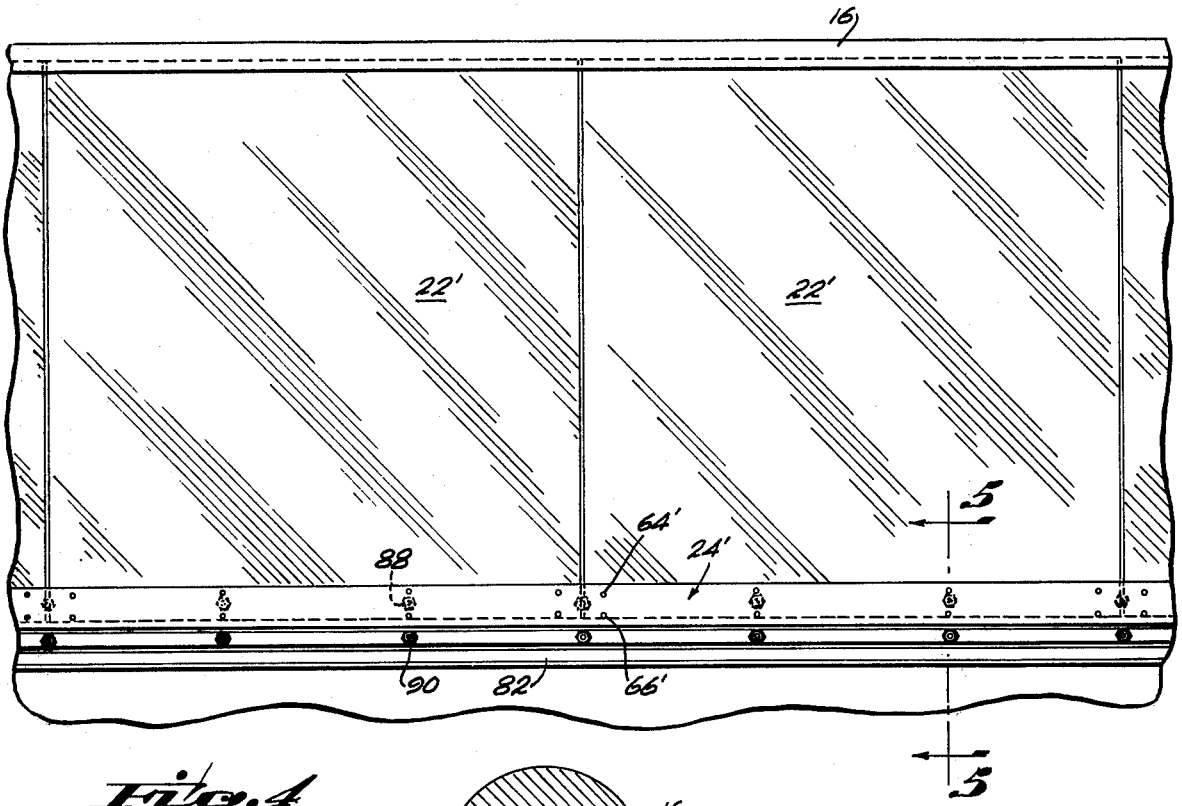
FIG. 4 is a fragmentary, elevational view of a first modification of the glass panel rail of the present invention.

Referring to FIGS. 4 and 5, a modified form of support member 24' is illustrated for mounting relative to a vertical side wall of a stairway, walkway or the like. In this instance a generally vertically, downwardly extending angle flange 82 is formed integral with the inside wall 62' of tubular support member 24'. Pluralities of upper and lower anchor bolts 84 and 86, having elongated inner portions embedded in the building structure B', provide outer ends extending respectively through the inner wall 62' and angle flange 82 for the reception of washers and bolts 88 and 90.

It should be noted that the adjustment plate 47 and pressure plate 50 may be continuous in form or may be formed of segments of predetermined lengths. In the form of the invention illustrated in FIGS. 4 and 5, segmental adjustment plates 47' are provided between the inwardly extended ends of anchor bolts 84 and washers and nuts 88. In all other respects, the various elements and their functions are identical with those described in FIGS. 2 and 3 and like reference numerals with prime designations are employed for identification purposes.

Figure 6:
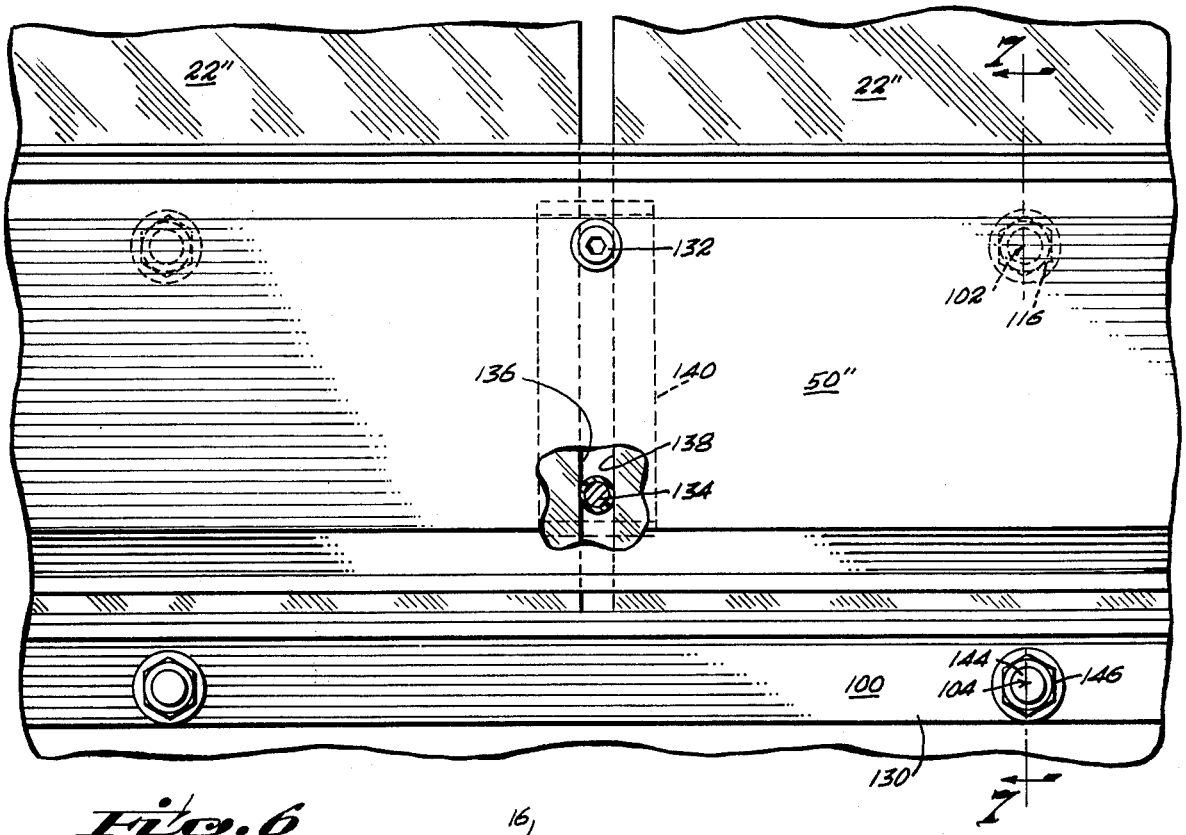
FIG. 6 is an enlarged, fragmentary, elevational view of a second modification of the invention.

With reference to FIGS. 6 and 7, a further modification of the invention is disclosed for installation relative to a vertical surface V. An elongated support member 100 is fixed by upper and lower pluralities of anchor bolts 102 and 104 providing elongated inner end portions 106 and 108 embedded in the building structure and outer ends projecting through appropriate holes 110 and 112 in support member 100. The upper bolts 102 extend through holes 110 into the upper portion of an outwardly opening cavity 114 formed in the support member 100 and are provided with washers and nuts 116 on their extended ends within cavity 114.

As seen in cross section in FIG. 7, the inner wall 120 of support member 100 includes a pair of longitudinally, oppositely inwardly angled wall portions 122 and 124 converging along a line 126 against the vertical building structure wall and bisecting the axes of upper anchor bolts 102. Support member 100 also includes a longitudinally, outwardly extending ledge 128, adjacent its lower end flange portion 130. The lower end portions 40'' of glass panels 22'' rest on a pad 131 fixed to the upper side of ledge 128.

A longitudinally extending pressure plate 50'' is disposed along the outer face of the lower end portions 40'' of the glass panels 22''. Longitudinally spaced apart pairs of upper and lower pressure bolts 132 and 134 extend through pressure plate 50'', between the confronting ends 136 and 138, FIG. 6, of each pair of glass panels 22'' into threaded engagement with common sliding nuts 140, slidably engaged in an undercut keyway 142, defined in cavity 114 to clamp the glass panels 22'' relative to the support member 100.

Lower anchor bolts 104 provide outer end portions 144 extending through appropriate holes in the lower end portion 130 of support member 100. Pairs of washers and adjusting nuts 146 and 148 are engaged on the outer end portions 144 against the respective inner and outer faces of lower end portion 130. Proper adjustment of the plurality of pairs of adjusting nuts 146 and 148 vertically rocks or pivots the support member 100 along the aforementioned line 126 to vertically align the plurality of glass panels 22''. Appropriate upper and lower pads 150 and 152, carried by support member 100 and pressure plate 50'' cushion the lower end portions 40'' of glass panels 22'' against damage.

As illustrated in FIG. 7, the upper ends of support member 100 and pressure plate 50'' may include upwardly extending prongs such as 154 and 156 for snap-on engagement of trim members 158 and 160. As indicated by broken lines 162 in all three forms of the invention, appropriate cover panels may be installed relative to the various structural assemblies. Floor coverings such as rugs on the stairways, halls, walkways, etc., are generally snugged up against the inner top edges of the structural elements as indicated by broken lines 164.

What is claimed is:

1. A railing for mounting to a building structure relative to an open stairway, hallway or the like comprising, a plruality of aligned glass panels, each of a predetermined length and height;

a continuous handrail fixed along the top lengths of said glass panels;

mounting means, fixed to the building structure, including means to supportingly engage the bottom lengths of said glass panels;

means to engage along lower end, first face portions of said glass panels, means to adjust said means to engage to bring the plurality of glass panels into said alignment;

means to exert pressure along lower end, second face portions of said glass panels, in an opposed relation to said means to engage, to maintain said panels in alignment;

said mounting means comprising an elongated, generally tubular member provided with a slot of a predetermined width, through a top wall thereof, opening into an interior chamber, defined in said tubular member;

said means to supportingly engage comprising a bottom wall of said tubular member;

a pad, fixed relative to said bottom wall, between said bottom lengths and bottom wall;

said glass panels extend loosely through said slot into engagement with said pad, and said means to engage along lower end, first face portions comprises adjustment plate means in said interior chamber;

said adjustment plate means, along a first edge, is pivotally engaged with said tubular member within said interior chamber.

2. The railing as defined in claim 1 wherein said means to adjust comprises a plurality of spaced apart set screws, engaged through a first side wall of said tubular member into engagement with said adjustment plate means, adjacent a second edge thereof.

3. The railing as defined in claim 2 wherein said means to exert pressure comprises pressure plate means in said interior chamber and a plurality of set screws, engaged through a second side wall of said tubular member into engagement with said pressure plate means.

4. The railing as defined in claim 3 wherein said plurality of set screws comprises first and second spaced apart pluralities thereof, positioned to engage said pressure plate means, respectively, adjacent top and bottom edges thereof.

5. A railing for mounting to a building structure relative to an open stairway, hallway or the like comprising, a plurality of aligned glass panels, each of a predetermined length and height;

a continuous handrail fixed along the top lengths of said glass panels;

mounting means, fixed to the building structure, including means to supportingly engage the bottom lengths of said glass panels;

means to engage along lower end, first face portions of said glass panels;

means to adjust said means to engage to bring the plurality of glass panels into said alignment;

means to exert pressure along lower end, second face portions of said glass panels, in an opposed relation to said means to engage, to maintain said panels in alignment, said mounting means comprising an elongated, generally tubular member provided with a slot of a predetermined width, through a top wall thereof, opening into an interior chamber, defined in said tubular member;

said tubular member including a pair of opposed, outwardly extending bottom flanges, each of which is provided with a plurality of spaced apart holes for the reception therethrough of outer end portions of anchor bolts having inner end portions embedded in a transversely, horizontally extending portion of the building structure, and lock means being provided on said outer end portions;

said railing including pads interposed between said adjustment plate means and pressure plate means, and the respective lower, side face portions of said glass panels.

6. A railing for mounting to a building structure relative to an open stairway, hallway or the like comprising, a plurality of aligned glass panels, each of a predetermined length and height;

a continuous handrail fixed along the top lengths of said glass panels;

mounting means, fixed to the building structure, including means to supportingly engage the bottom lengths of said glass panels;

means to engage along lower end, first face portions of said glass panels;

means to adjust said means to engage to bring the plurality of glass panels into said alignment;

means to exert pressure along lower end, second face portions of said glass panels, in an opposed relation to said means to engage, to maintain said panels in alignment;

said mounting means comprising an elongated, generally tubular member provided with a slot of a predetermined width, through a top wall thereof, opening into an interior chamber, defined in said tubular member;

said tubular member including a downwardly extending flange formed integral with an inside wall thereof, said inside wall and flange being provided with pluralities of spaced apart holes for the reception therethrough of outer end portions of anchor bolts having inner end portions embedded in a vertical wall portion of a building structure, lock means being provided on said outer end portions.

7. A railing for mounting to a building structure relative to an open stairway, hallway or the like comprising, a plurality of aligned glass panels, each of a predetermined length and height;

a continuous handrail fixed along the top lengths of said glass panels;

mounting means, fixed to the building structure, including means to supportingly engage the bottom lengths of said glass panels, means to engage along lower end, first face portions of said glass panels;

means to adjust said means to engage to bring the plurality of glass panels into said alignment;

means to exert pressure along lower end, second face portions of said glass panels, in an opposed relation to said means to engage, to maintain said panels in alignment;

said mounting means comprising an elongated, generally tubular member provided with a slot of a predetermined width, through a top wall thereof, opening into an interior chamber, defined in said tubular member, said means to supportingly engage comprising a bottom wall of said tubular member;

a pad, fixed relative to said bottom wall, between said bottom lengths and bottom wall;

said glass panels extend loosely through said slot into engagement with said pad, and said means to engage along lower end, first face portions comprises adjustment plate means in said interior chamber;

said railing including a pair of O-formed seal members disposed in said slot on opposed sides of said glass panels and fixed in respective edge portions defined by said slot.

8. A railing for mounting to a building structure relative to an open stairway, hallway or the like comprising, a plurality of aligned glass panels, each of a predetermined length and height;

a continuous handrail fixed along the top lengths of said glass panels;

mounting means, fixed to the building structure, including means to supportingly engage the bottom lengths of said glass panels;

means to engage along lower end, first face portions of said glass panels;

means to adjust said means to engage to bring the plurality of glass panels innto said alignment;

menas to exert pressure along lower end, second face portions of said glass panels, in an opposed relation to said means to engage, to maintain said panels in alignment;

said mounting means comprising an elongated member having an enlarged upper portion providing an outwardly opening cavity, downwardly extending integral flange portion and an outwardly extending ledge from said flange portion comprising said means to supportingly engage;

including upper and lower pluralities of spaced apart anchor bolts including inner end portions embedded in a vertical wall portion of a building structure, and outer end portions extending through respective pluralities of holes in said enlarged upper portion and flange portion, lock nuts being engaged on the outer end portions of said upper plurality, and a pair of adjustment nuts being engaged on each of said lower plurality in respective engagement against inner and outer faces of said flange portion.

9. The railing as defined in claim 8 wherein said means to engage along lower end, first face portions comprises upper and lower outwardly, longitudinally extending projections from said enlarged upper portion.

10. The railing as defined in claim 9 wherein said means to adjust comprises a pair of longitudinally, oppositely inwardly angled wall portions of said enlarged upper portion converging along a line against the surface of said vertical wall portion in a bisecting relation to the axes of said upper plurality of anchor bolts, and said pair of adjustment nuts on each of said lower plurality of anchor bolts.

11. The railing as defined in claim 10 wherein said means to exert pressure comprises longitudinally extending pressure plate means and a plurality of upper and lower pairs of pressure bolts extending therethrough, each pair being positioned to pass from said pressure plate means through a space between confronting ends of a pair of said glass panels into threaded engagement with nut means in said outwardly opening cavity.

12. The railing as defined in claim 11 wherein said nut means comprises a single enlarged nut for engagement by each pair of pressure bolts, said nuts being slidably engaged in an undercut keyway in said outwardly opening cavity.

13. The railing as defined in claim 11 including pads, interposed between said oppositely inwardly angled wall portions and pressure plate means, and the respective lower, side face portions of said glass panels.

14. The railing as defined in claim 8 including a pad, fixed relative to said ledge, between said bottom lengths and ledge.

* * * * *